US010323658B2

(12) United States Patent
Deng

(10) Patent No.: US 10,323,658 B2
(45) Date of Patent: Jun. 18, 2019

(54) HYDRAULIC DRIVE SYSTEM FOR OPERATION TABLE

(71) Applicant: NANJING MINDRAY BIO-MEDICAL ELECTRONICS CO., LTD., Jiangsu (CN)

(72) Inventor: Qiangquan Deng, Jiangsu (CN)

(73) Assignee: Nanjing Mindray Bio-Medical Electronics Co., Ltd., Nanjing (CN)

( * ) Notice: Subject to any disclaimer, the term of this patent is extended or adjusted under 35 U.S.C. 154(b) by 185 days.

(21) Appl. No.: 15/460,008

(22) Filed: Mar. 15, 2017

(65) Prior Publication Data

US 2017/0184136 A1 Jun. 29, 2017

Related U.S. Application Data

(63) Continuation of application No. PCT/CN2014/086496, filed on Sep. 15, 2014.

(51) Int. Cl.
*F15B 13/04* (2006.01)
*A61G 13/02* (2006.01)
(Continued)

(52) U.S. Cl.
CPC ..... *F15B 13/0401* (2013.01); *A61G 13/02* (2013.01); *F15B 13/023* (2013.01); *F15B 13/0839* (2013.01); *F15B 2013/041* (2013.01); *F15B 2211/20538* (2013.01); *F15B 2211/20561* (2013.01); *F15B 2211/3057* (2013.01); *F15B 2211/30515* (2013.01); *F15B 2211/30565* (2013.01); *F15B 2211/327* (2013.01);
(Continued)

(58) Field of Classification Search
CPC ..... A61G 13/02; F15B 13/0401; F15B 13/0839; F15B 13/023; F15B 2211/30515
See application file for complete search history.

(56) References Cited

U.S. PATENT DOCUMENTS 3,957,244 A * 5/1976 Chauvigne ..... F16K 31/385 251/30.05
3,977,664 A 8/1976 Mitchell et al.
(Continued)

FOREIGN PATENT DOCUMENTS

CN 201036603 Y 3/2008
CN 103486104 A 1/2014
(Continued)

*Primary Examiner* — Abiy Teka
(74) *Attorney, Agent, or Firm* — Kory D. Christensen

(57) ABSTRACT

A hydraulic drive system includes an oil supply device, an oil return device and a hydraulic cylinder circuit component. The circuit component includes a hydraulic cylinder, a first and a second two-position two-way electromagnetic directional valves. The cylinder includes a first chamber and a second chamber that has a piston rod. A first port of the first valve connects with the first chamber and a first port of the second valve connects with the second chamber. When the oil supply device connects to a second port of the first valve and a second port of the second valve connects to the oil return device, the piston rod is extended outwards. When the oil supply device connects to the second port of the second valve and the second port of the first valve connects to the oil return device, the piston rod is retracted.

17 Claims, 5 Drawing Sheets

(51) Int. Cl.
*F15B 13/02* (2006.01)
*F15B 13/08* (2006.01)

(52) U.S. Cl.
CPC ..... *F15B 2211/40507* (2013.01); *F15B 2211/41527* (2013.01); *F15B 2211/46* (2013.01)

(56) References Cited

U.S. PATENT DOCUMENTS

| | | | |
|---|---|---|---|
| 4,195,829 | A | 4/1980 | Reser |
| 2003/0061662 | A1 | 4/2003 | Strobel et al. |

FOREIGN PATENT DOCUMENTS

| | | | | |
|---|---|---|---|---|
| DE | 4301547 | A1 * | 8/1994 | ..... A47C 20/041 |
| EP | 0463734 | A2 | 1/1992 | |

* cited by examiner

HYDRAULIC DRIVE SYSTEM FOR OPERATION TABLE

CROSS-REFERENCE TO RELATED APPLICATIONS

This application is a continuation of PCT Application No. PCT/CN2014/086496, filed Sep. 15, 2014, for "Hydraulic Drive System for Operation Table," with inventor Deng Qiangquan, which is incorporated herein by reference.

TECHNICAL FIELD

This disclosure relates to a hydraulic drive system for an operation table.

BACKGROUND

Operation tables, including both surgical tables and surgical beds, are capable of adjusting operating positions in order to expose the surgery field and ensure a successful surgery. Electro-hydraulic operation tables may be driven by an electro-hydraulic system, where an oil cylinder may be controlled to make reciprocating movement by hydraulic directional valves to enable various actions of the electro-hydraulic operation tables.

SUMMARY OF THIS DISCLOSURE

In one aspect, a hydraulic drive system for an operation table is provided, where the system is provided with a first working state and a second working state, the two states being switchable with each other. The hydraulic drive system may include an oil supply device, an oil return device and at least one hydraulic cylinder circuit component. Each hydraulic cylinder circuit component may include a hydraulic cylinder, a first two-position, two-way electromagnetic directional valve and a second two-position, two-way electromagnetic directional valve. The hydraulic cylinder may include a first chamber without a piston rod and a second chamber with a piston rod disposed therein. A first port of the first two-position, two-way electromagnetic directional valve is connected with the first chamber through a first flow pass, and a first port of the second two-position, two-way electromagnetic directional valve is connected with the second chamber through a second flow pass. In the first working state, the oil supply device may be connected to a second port of the first two-position, two-way electromagnetic directional valve, and the oil return device may be connected to a second port of the second two-position, two-way electromagnetic directional valve, such that the piston rod in the second chamber may extend outwards. In the second working state, the oil supply device may be connected to the second port of the second two-position, two-way electromagnetic directional valve, and the oil return device may be connected to the second port of the first two-position, two-way electromagnetic directional valve, such that the piston rod in the second chamber may retract inwards.

In the first working state, hydraulic oil may be provided from the oil supply device to the first chamber through the first two-position, two-way electromagnetic directional valve, and returned back from the second chamber to the oil return device through the second two-position, two-way electromagnetic directional valve. In the second working state, hydraulic oil may be provided from the oil supply device to the second chamber through the second two-position, two-way electromagnetic directional valve, and returned back from the first chamber to the oil return device through the first two-position, two-way electromagnetic directional valve.

In some embodiments, each hydraulic cylinder circuit component may correspond to one of multiple actions of an operation table. The multiple actions of the operation table may be controlled in combination through on-off control of the first and second two-position, two-way electromagnetic directional valves of each hydraulic cylinder circuit component.

In some embodiments, the oil supply device may be a unidirectional hydraulic pump, where the first working state and the second working state are switched by a third directional valve. In one embodiment, the unidirectional hydraulic pump, the oil return device, the first two-position, two-way electromagnetic directional valve and the second two-position, two-way electromagnetic directional valve are each connected with respective ports of the third directional valve.

In some embodiments, the oil supply device may be a bi-directional hydraulic pump that has two outlets. In the first working state, the hydraulic oil may be provided to the first two-position, two-way electromagnetic directional valve through one of the two outlets of the bi-directional hydraulic pump. In the second working state, the hydraulic oil may be provided to the second two-position, two-way electromagnetic directional valve through the other one of the two outlets of the bi-directional hydraulic pump.

The second port of the first two-position, two-way electromagnetic directional valve and the second port of the second two-position, two-way electromagnetic directional valve may be respectively connected with the oil return device through two return lines, and the two outlets of the bi-directional hydraulic pump may be respectively connected with the two oil return lines.

In some embodiments, a throttling device that may be used for flow regulation may be provided on both the first flow pass and the second flow pass. The throttling device may be, for example, a throttle bolt, a speed throttle valve or other devices which enable flow regulation, so as to regulate a movement speed of the piston rod and a movement speed of any action of the operation table.

In some embodiments, an overflow pass may be provided between the oil supply device and the oil return device, where an overflow valve may be provided in the overflow pass.

In some embodiments, both the first and second two-position, two-way electromagnetic directional valves may include an electromagnet, a valve element, a valve orifice and two ports (i.e., the first port and the second port described above). The valve element may have an open position and a closed position. At the open position, the electromagnet may be attached to the valve element, so that the valve element may leave the valve orifice and the two ports may be connected. At the closed position, the electromagnet may be detached from the valve element, so that the valve element may block the valve orifice and the two ports may be isolated, thereby shutting off the oil flow in both directions. Accordingly, the flow passes may be controlled to be opened or closed by the first and second two-position, two-way electromagnetic directional valves. Here, both directions may be, for example, a direction from one port (e.g., the first port) to the other port (e.g., the second port)

and an opposite direction from said other port (e.g., the second port) to said port (e.g., the first port).

DETAILED DESCRIPTION

A unidirectional hydraulic pump and one three-position, four-way hydraulic directional valve may be used to control a hydraulic cylinder for reciprocating movement. A unidirectional hydraulic pump and one three-position, five-way hydraulic directional valve may be used to control a hydraulic cylinder for reciprocating movement. A unidirectional hydraulic pump and two two-position, three-way electromagnetic directional valves may be used to control a hydraulic cylinder for reciprocating movement. A unidirectional hydraulic pump and four two-position, two-way directional valves may be used to control a hydraulic cylinder for reciprocating movement. A unidirectional hydraulic pump and a hand-operated or foot-operated multiposition directional valve may be used to control a hydraulic cylinder for reciprocating movement. A hand pump or foot pump and a hand-operated or foot-operated multiposition directional valve may be used to control a hydraulic cylinder for reciprocating movement. A bi-directional hydraulic pump and a rotary directional valve may be used to control a hydraulic cylinder for reciprocating movement.

Figure 1:
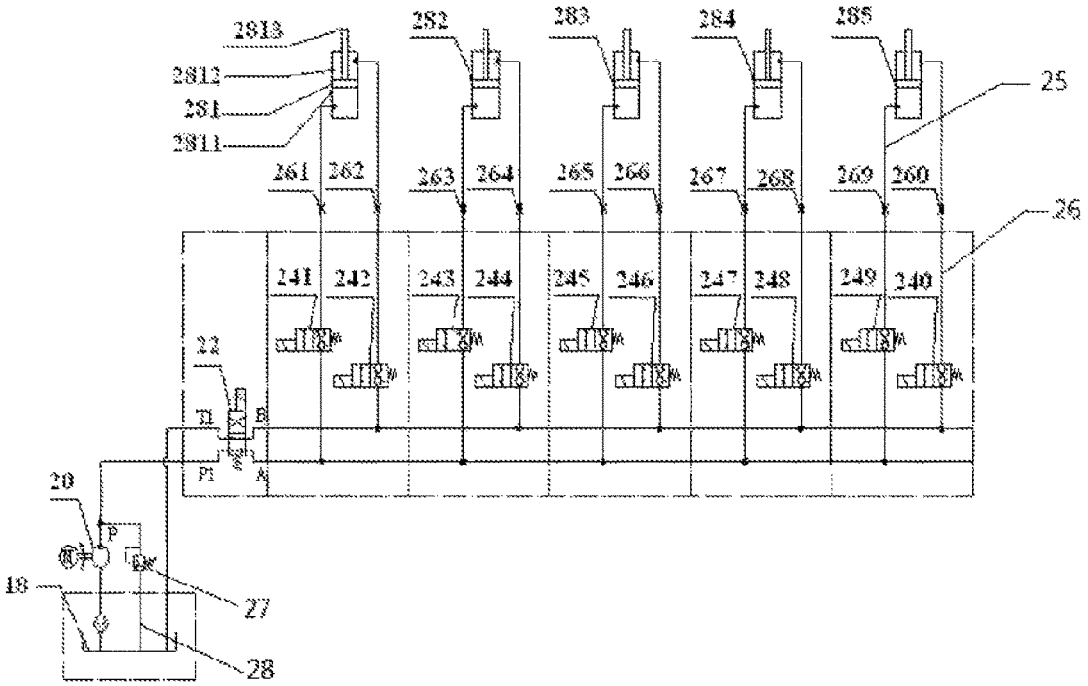
FIG. 1 is a structure diagram for a hydraulic drive system for an operation table according to one embodiment.
Figure 2:
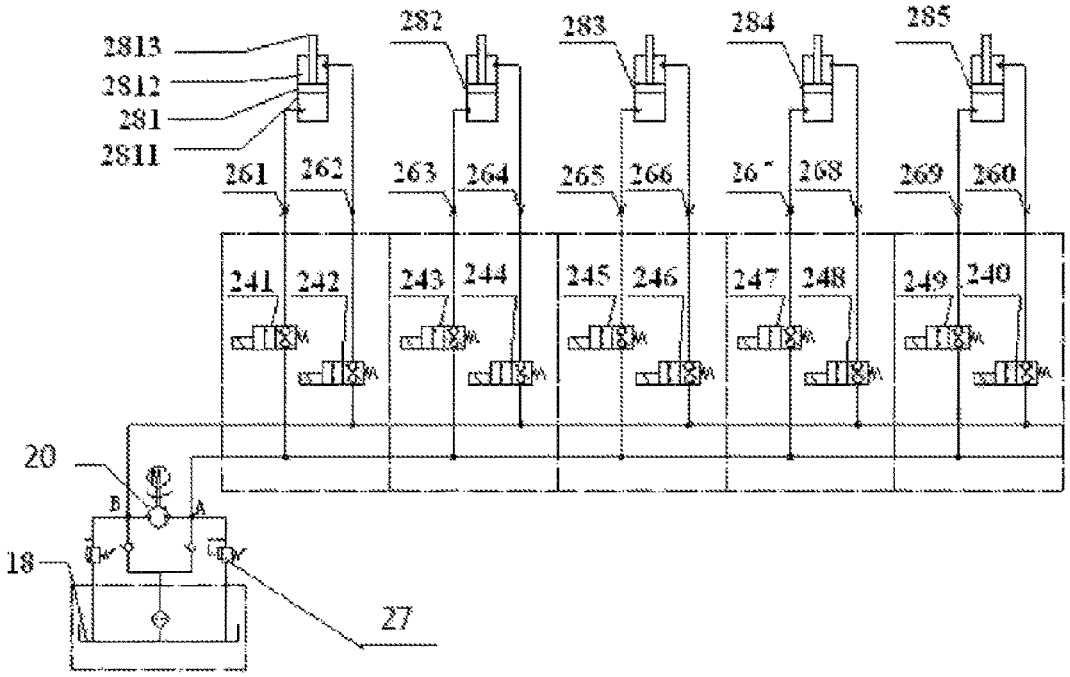
FIG. 2 is a structure diagram for a hydraulic drive system for an operation table according to another embodiment.

As shown in FIGS. 1-2, a hydraulic drive system for an operation table may include an oil supply device 20, an oil return device 18 and one or more hydraulic cylinder circuit components. The oil supply device 20 is able to supply hydraulic oil, and the oil return device 18 may be used for receiving the returned hydraulic oil. Each hydraulic cylinder circuit component may include a hydraulic cylinder 281, 282, 283, 284, 285, a first two-position, two-way electromagnetic directional valve 241, 243, 245, 247, 249, and a second two-position, two-way electromagnetic directional valve 242, 244, 246, 248, 240. The hydraulic cylinder may include a first chamber 2811 without a piston rod and a second chamber 2812 with a piston rod 2813 disposed therein. A first port of the first two-position, two-way electromagnetic directional valves 241, 243, 245, 247, 249 is connected with the first chamber 2811, and a first port of the second two-position, two-way electromagnetic directional valves 242, 244, 246, 248, 240 is connected with the second chamber 2812.

The hydraulic drive system for the operation table may have two working states, referred to herein as a first working state and a second working state, where the first and second working states may be switched with each other.

In the first working state, the oil supply device 20 may be connected to a second port of the first two-position, two-way electromagnetic directional valve, i.e., the hydraulic oil may be provided from the oil supply device to the first chamber through the first two-position, two-way electromagnetic directional valve. Meanwhile, the oil return device may be connected to a second port of the second two-position, two-way electromagnetic directional valve, i.e., the hydraulic oil within the second chamber may flow into the oil return device 18 through the second two-position, two-way electromagnetic direction valve. Since the hydraulic oil enters the first chamber 2811 and flows out of the second chamber 2812, the piston rod 2813 in the second chamber 2812 may extend outwards.

In the second working state, the oil supply device 20 may be connected to the second port of the second two-position, two-way electromagnetic directional valve, i.e., the hydraulic oil may be provided from the oil supply device to the second chamber through the second two-position, two-way electromagnetic directional valve. Meanwhile, the oil return device may be connected to the second port of the first two-position, two-way electromagnetic directional valve, i.e., the hydraulic oil within the first chamber may flow into the oil return device 18 through the first two-position, two-way electromagnetic direction valve. Since the hydraulic oil enters the second chamber 2812 and flows out of the first chamber 2811, the piston rod 2813 in the second chamber may retract inwards.

The operation table may include multiple movable parts. Those movable parts correspond to the plurality of hydraulic cylinder circuit components, and may be moved relative to each other. Hence, relative positions of those movable parts may be adjusted, by controlling the hydraulic cylinders respectively corresponding to the movable parts, to place the operation table at different positions so as to meet different surgery requirements. When the operation table performs different actions, the movable part(s) may be guided to move by the piston rod(s) of the corresponding hydraulic cylinder(s).

Respective valve element of the first and second two-position, two-way electromagnetic directional valves have an open position and a closed position. At the open position, the hydraulic oil may flow through the directional valve, such that the piston rod of the hydraulic cylinder may be moved. At the closed position, the hydraulic oil is shut off and is unable to flow through the directional valve, and thus the piston rod of the hydraulic cylinder may be held at its current position.

Using the hydraulic drive system of this embodiment, only one oil supply device is needed, and it is able to control the reciprocating movement of the hydraulic cylinder in a single hydraulic circuit through selective connection of the first two-position, two-way electromagnetic directional valve and the second two-position, two-way electromagnetic directional valve with the oil supply device and the oil return device. In this way, the whole drive system is simple in structure and low in cost. Moreover, the operation table may be stably held at the desired position since the first and second two-position, two-way electromagnetic directional valves may shut off the hydraulic oil flow in both directions between the first and second ports of one two-position, two-way electromagnetic directional valve.

All the two-position, two-way electromagnetic directional valves may be assembled together or may be assembled together with the third directional valve so as to form an integrated module. In this way, the hydraulic drive system may become more compact and have smaller dimensions. This devices of this disclosure may control and drive any expected number of action(s) of the operation table by adding or removing one or more two-position, two-way electromagnetic directional valves.

FIG. 1 illustrates an embodiment of a hydraulic drive system for the operation table.

The hydraulic drive system for the operation table may include an oil supply device 20, an oil return device 18, a plurality of groups of hydraulic cylinder circuit components and one four-way electromagnetic directional valve 22. The oil supply device 20 is a unidirectional hydraulic pump with one outlet P. Each hydraulic cylinder circuit component may include a hydraulic cylinder 281, 282, 283, 284, 285, a first two-position, two-way electromagnetic directional valve having two ports (a first port and a second port) 241, 243, 245, 247, 249, and a second two-position, two-way electromagnetic directional valve having two ports (a first port and a second port) 242, 244, 246, 248, 240. The hydraulic cylinder 281 may include a first chamber 2811 without a piston rod and a second chamber 2812 with a piston rod 2813 disposed therein. The first port of the first two-position, two-way electromagnetic directional valve 241, 243, 245, 247, 249 is connected with the first chamber 2811 through a first flow pass 25, and a throttling orifice 261, 263, 265, 267, 269 may be respectively provided in each first flow pass 25 for flow regulation. The first port of the second two-position, two-way electromagnetic directional valve 242, 244, 246, 248, 240 may be connected with the second chamber 2812 through a second flow pass 26, and a throttling orifice 262, 264, 266, 268, 260 may be respectively provided in each second flow pass 26. Four ports P1, T1, A, B of the four-way electromagnetic directional valve 22 may be respectively connected with the unidirectional hydraulic pump, the oil return device 18, the second port of each first two-position, two-way electromagnetic directional valve 241, 243, 245, 247, 249 and the second port of each second two-position, two-way electromagnetic directional valve 242, 244, 246, 248, 240. An overflow pass 28 provided with an overflow valve 27 may be further disposed between the oil supply device 20 and the oil return device 18.

Operation of the hydraulic drive system for the operation table is described as follows.

The unidirectional hydraulic pump may be started such that the hydraulic oil may be outputted through the outlet P to the port P1 of the four-way electromagnetic directional valve 22. When the four-way electromagnetic directional valve 22 is at a free position, the hydraulic oil may flow from the port P1 to the port A to get connected to the second port of the first two-position, two-way electromagnetic directional valve 241, 243, 245, 247, 249. When the first two-position, two-way electromagnetic direction valve is not energized, the hydraulic oil cannot flow through the first two-position, two-way electromagnetic direction valve, and thus each flow pass is completely shut off. Provided that it is needed to drive the piston rod 2813 to extend out of the hydraulic cylinder 281 to enable a certain action of the operation table, the first two-position, two-way electromagnetic directional valve 241 is required to be energized, in which case the hydraulic oil may flow through the first two-position, two-way electromagnetic directional valve 241 and the throttling orifice 261 to enter into the first chamber 2811 of the hydraulic cylinder 281. Meanwhile, the second two-position, two-way electromagnetic directional valve 241 is also required to be energized. In this way, the hydraulic oil that has entered into the first chamber 2811 of the hydraulic cylinder 281 may drive the piston rod 2813 to extend outwards. The hydraulic oil within the second chamber 2812 of the hydraulic cylinder may first flow through the throttling orifice 262 and the second two-position, two-way electromagnetic directional valve 242, flow to the port B of the four-way electromagnetic directional valve 22 along the second flow pass, and finally flows back into the oil return device 18 through the port T1. When the unidirectional hydraulic pump is controlled to continuously output the hydraulic oil, the four-way electromagnetic directional valve 22 is kept at the free position, and the first and second two-position, two-way electromagnetic directional valves 241, 242 are maintained to be energized, the piston rod 2813 of the hydraulic cylinder 281 may extend outwards till its stroke end.

When it is needed to drive the piston rod 2813 of the hydraulic cylinder 281 to retract inwards so as to enable a return stroke for a certain action of the operation table, the unidirectional hydraulic pump may be started such that the hydraulic oil may be outputted through the outlet P to the port P1 of the four-way electromagnetic directional valve 22. When the four-way electromagnetic directional valve 22 is at an energized position, the hydraulic oil may flow from the port P1 to the port B to get connected to the second port of the second two-position, two-way electromagnetic directional valve 242, 244, 246, 248, 240. The second two-position, two-way electromagnetic directional valve 242 is required to be energized, in which case the hydraulic oil may flow through the second two-position, two-way electromagnetic directional valve 242 and the throttling orifice 262 to enter into the second chamber 2812 of the hydraulic cylinder 281. Meanwhile, the first two-position, two-way electromagnetic directional valve 241 is also required to be energized. In this way, the hydraulic oil that has entered into the second chamber 2812 of the hydraulic cylinder 281 may drive the piston rod 2813 to retract back. The hydraulic oil within the first chamber 2811 of the hydraulic cylinder may first flow through the throttling orifice 261 and the first two-position, two-way electromagnetic directional valve 241, flow to the port A of the four-way electromagnetic directional valve 22 along the first flow pass, and finally flow back into the oil return device 18 through the port T1. When the unidirectional hydraulic pump is controlled to continuously output the hydraulic oil, the four-way electromagnetic directional valve 22 is kept at the energized position, and the first and second two-position, two-way electromagnetic directional valves 241, 242 are maintained to be energized, the piston rod 2813 of the hydraulic cylinder 281 may be retracted from a stop position of the extending stroke till a stroke beginning, and accordingly a complete hydraulic circuit may be formed by the first and second flow passes.

The operation control of the hydraulic cylinders 282, 283, 284, 285 is the same as that of the hydraulic cylinder 281 described above. As long as it is able to selectively connect the four-way electromagnetic directional valve 22 with the flow passes and the two-position, two-way electromagnetic directional valves in the corresponding hydraulic circuit, the piston rod of the hydraulic cylinder may be driven to extend outwards and retract inwards, so as to control back-and-forth movement of any action of the operation table.

When the operation table has performed any action using the above-described control method and it is demanded to hold the current position of the operation table, it is only needed to not energize both the first and second two-position, two-way electromagnetic directional valves 241, 242 in the hydraulic circuit where the hydraulic cylinder (such as the hydraulic cylinder 281) that is operated to drive said action of the operation table is located. In this case, the valve elements of the first and second two-position, two-way electromagnetic directional valves may shut off the hydraulic oil flow in both directions, and the hydraulic oil within both the first chamber 2811 and the second chamber 2812 may be held within a sealed cavity without any discharge, thereby holding the current position of the operation table reliably and stably.

Figure 5:
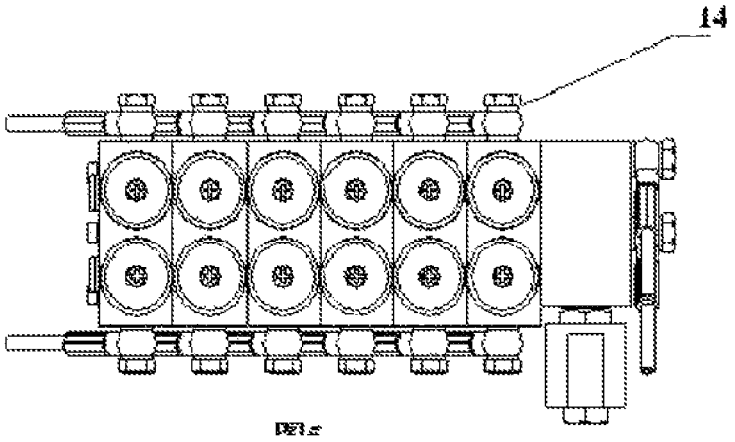
FIGS. 5-7 are respectively a front view, a top view and a left view for an assembly of multiple two-position, two-way electromagnetic directional valves and four-way electromagnetic directional valves.
Figure 6:
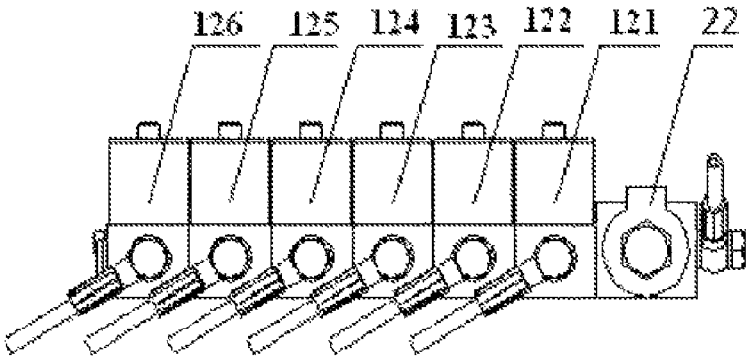
Figure 7:
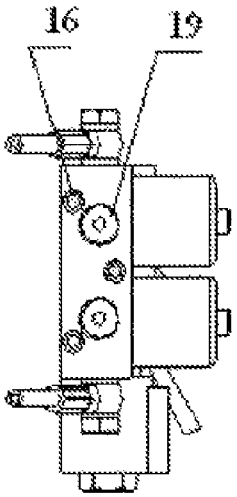

FIGS. 5-7 are structure diagrams for an assembly of the four-way electromagnetic directional valve 22 and six groups of two-position, two-way electromagnetic directional valves 121, 122, 123, 124, 125 used in the first embodiment of this disclosure, where each group of two-position, two-way electromagnetic directional valve is assembled by two two-position, two-way electromagnetic directional valves. This assembly may cooperate with the unidirectional hydraulic pump to control and drive six reciprocating actions of the operation table. Also, it is able to control and drive any number of actions of the operation table by adding or removing one or more two-position, two-way electromagnetic directional valves. A pipe and its pipe adapter 14 may be used to connect the hydraulic cylinder with the valves or connect the valves with the hydraulic pump, a screw 16 may be used to secure the two-position, two-way electromagnetic directional valves and the four-way electromagnetic directional valve 22, and a hydraulic plug screw may be used to block the port of the two-position, two-way electromagnetic directional valve (which port is connected with the flow pass). Alternatively, such assembled four-way and two-position, two-way electromagnetic directional valves may be disassembled and/or reassembled according to various requirements of the operation table.

FIG. 2 illustrates another embodiment of the hydraulic drive system for the operation table. The difference between these two embodiments shown in FIGS. 1 and 2 may lie in that the four-way electromagnetic directional valve 22 is removed from the hydraulic drive system and the unidirectional hydraulic pump is replaced by a bi-directional hydraulic pump in the second embodiment. The operation of the second embodiment is described below.

When the bi-directional hydraulic pump is started to rotate clockwise, the hydraulic oil may be outputted through an outlet A and may flow to the second port of the first two-position, two-way electromagnetic directional valve 241, 243, 245, 247, 249. When the first two-position, two-way electromagnetic directional valve is not energized, the hydraulic oil cannot pass through the first two-position, two-way electromagnetic directional valve, and thus each flow pass is completely shut off. When it is needed to drive the piston rod 2813 of the hydraulic cylinder 281 to extend outwards to enable a certain action of the operation table, the first two-position, two-way electromagnetic directional valve 241 is required to be energized, in which case the hydraulic oil may flow through the first two-position, two-way electromagnetic directional valve 241 and the throttling orifice 261 to enter into the first chamber 2811 of the hydraulic cylinder 281. Meanwhile, the second two-position, two-way electromagnetic directional valve 241 is also required to be energized. In this way, the hydraulic oil that has entered into the first chamber 2811 of the hydraulic cylinder 281 may drive the piston rod 2813 to extend outwards. Also, the hydraulic oil within the second chamber 2812 of the hydraulic cylinder may first flow through the throttling orifice 262 and the second two-position, two-way electromagnetic directional valve 242, and then flows back into the oil return device 18 along the second flow pass. When the bi-directional hydraulic pump is controlled to continuously output the hydraulic oil, and the first and second two-position, two-way electromagnetic directional valves 241, 242 are kept to be energized, the piston rod 2813 of the hydraulic cylinder 281 may be driven to extend outwards till its stroke end.

When it is needed to drive the piston rod 2813 of the hydraulic cylinder 281 to retract inwards so as to enable a return stroke for a certain action of the operation table, the bi-directional hydraulic pump may be started to rotate counterclockwise, such that the hydraulic oil may be outputted through an outlet B and may then flow to the second port of the second two-position, two-way electromagnetic directional valve 242, 244, 246, 248, 240. The second two-position, two-way electromagnetic directional valve 242 is required to be energized, in which case the hydraulic oil may flow through the second two-position, two-way electromagnetic directional valve 242 and the throttling orifice 262 to enter into the second chamber 2812 of the hydraulic cylinder 281. Meanwhile, the first two-position, two-way electromagnetic directional valve 241 is also required to be energized. In this way, the hydraulic oil that has entered into the second chamber 2812 of the hydraulic cylinder 281 may drive the piston rod 2813 to retract back. The hydraulic oil within the first chamber 2811 of the hydraulic cylinder may first flow through the throttling orifice 261 and then flow back into the oil return device 18 along the first flow pass. When the bi-directional hydraulic pump is controlled to continuously output the hydraulic oil, and the first and second two-position, two-way electromagnetic directional valves 241, 242 are kept to be energized, the piston rod 2813 of the hydraulic cylinder 281 may be driven to retract from a stop position of the extending stroke till a stroke beginning, and accordingly a complete hydraulic circuit may be formed by the first and second flow passes.

The operation control of the hydraulic cylinders 282, 283, 284, 285 in FIG. 2 may be the same as that of the hydraulic cylinder 281 described above. As long as it is able to control the clockwise and counterclockwise rotation of the bi-directional hydraulic pump to alternatively output the hydraulic oil from the outlet A or B and it is able to selectively connect the bi-directional hydraulic pump with the first and second two-position, two-way electromagnetic directional valves in the corresponding hydraulic circuit, the piston rod of the hydraulic cylinder may be driven to extend outwards and retract inwards, so as to control back-and-forth movement of any action of the operation table.

Figure 8:
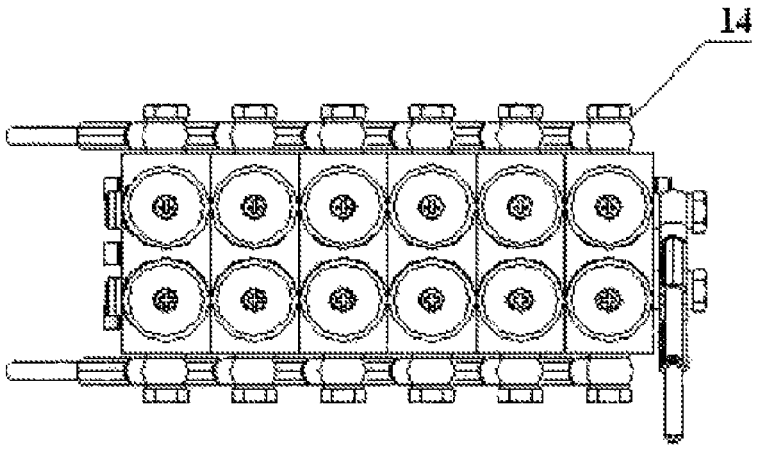
FIGS. 8-10 are respectively a front view, a top view and a left view for an assembly of multiple two-position, two-way electromagnetic directional valves.
Figure 9:
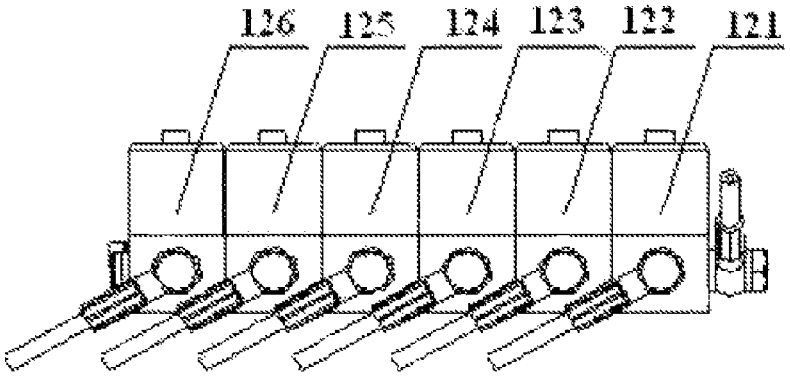
Figure 10:
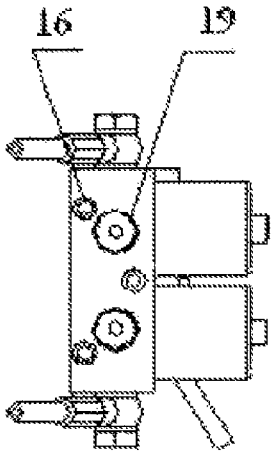
Figure 11:
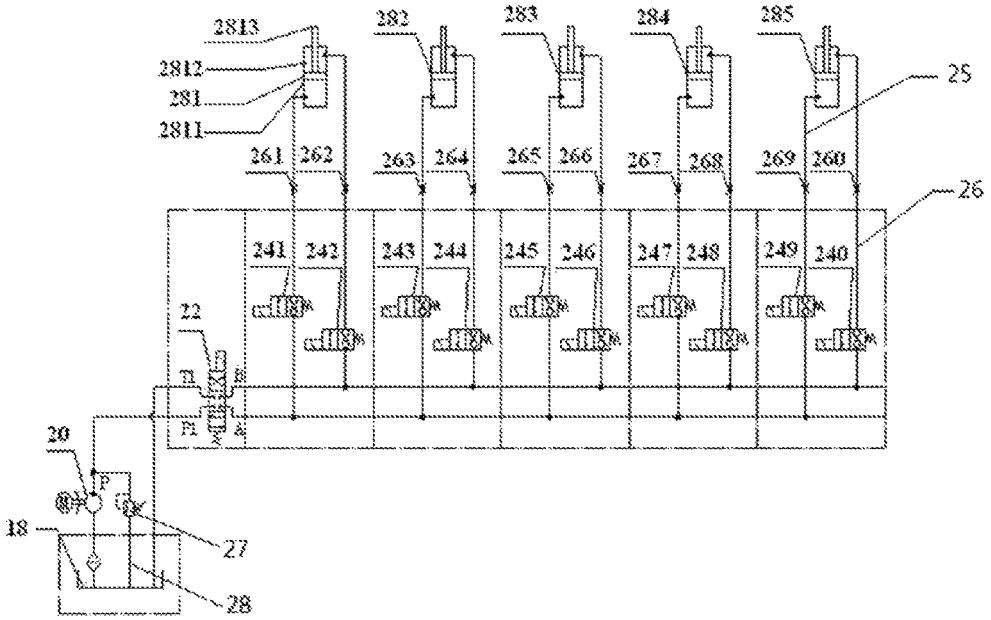
FIG. 11 is a structure diagram for a hydraulic drive for an operation table.

FIGS. 8-10 are structure diagrams for an assembly of six groups of two-position, two-way electromagnetic directional valves 121, 122, 123, 124, 125 used in the second embodiment of this disclosure, where each group of two-position, two-way electromagnetic directional valve is assembled by two two-position, two-way electromagnetic directional valves. This assembly may cooperate with the bi-directional hydraulic pump to control and drive six reciprocating actions of the operation table. Also, it is able to control and drive any number of actions of the operation table by adding or removing one or more two-position, two-way electromagnetic directional valves. A pipe and its pipe adapter 14 may be used to connect the hydraulic cylinder with the valves or connect the valves with the hydraulic pump, a screw 16 may be used for secured connection of the two-position, two-way electromagnetic directional valves, and a hydraulic plug screw may be used to block the port of the two-position, two-way electromagnetic directional valve (which port is connected to the flow pass). Alternatively, such assembled two-position, two-way electromagnetic directional valves may be disassembled and/or reassembled according to various requirements of the operation table.

Figure 3:
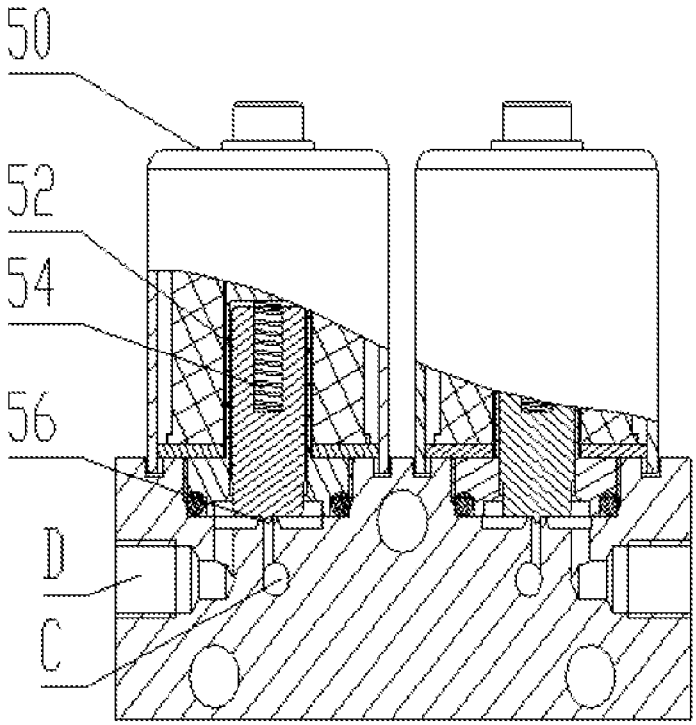
FIG. 3 is a sectional view at a front-view orientation for a two-position, two-way electromagnetic directional valve.
Figure 4:
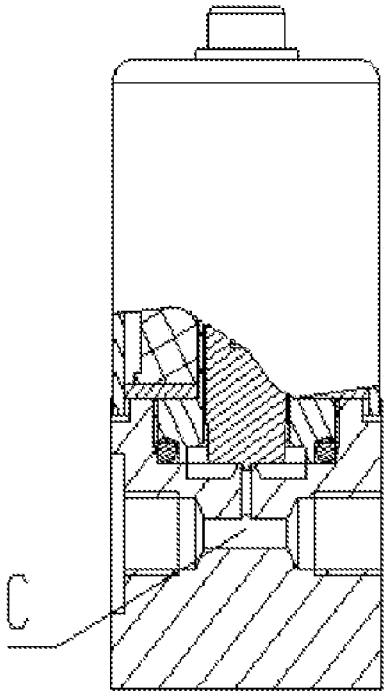
FIG. 4 is a sectional view at a left-view orientation for a two-position, two-way electromagnetic directional valve.

As shown in FIG. 3, the two-position, two-way electromagnetic directional valve may include an electromagnet 50, a spring 54, a valve element 52, a port C (i.e., the second port described above), a port D (i.e., the first port described above) and a valve orifice 56 located between the two ports. The spring 54 may exert a pretension force onto the valve element, the hydraulic oil flowing to the port D may exert a first hydraulic force onto the valve element, and the hydraulic oil flowing to the port C may exert a second hydraulic force onto the valve element.

When the two-position, two-way electromagnetic directional valve is used in the hydraulic drive system of this disclosure, the port C is connected to the oil supply device or the oil return device, and the port D is connected to the first chamber or the second chamber of the hydraulic cylinder. In this case, the amount of hydraulic oil flowing to the port C may be set to be determined by a working pressure of the oil supply device of the hydraulic drive system, and thus the second hydraulic force is determined according to the working pressure of the hydraulic drive system. In an embodiment of this disclosure, the spring 54 and the hydraulic oil flowing to the port D may act upon an upper end of the valve element, and the hydraulic oil flowing to the port C may act upon a lower end of the valve element. Accordingly, the pretension force and the first hydraulic force are in a same direction, while the pretension force and the second hydraulic force are in two opposite directions. Furthermore, an action area of the spring and the hydraulic oil acting upon the upper end of the valve element is set to be greater than that of the hydraulic oil acting upon the lower end of the valve element, and the pretension force is set to be greater than the second hydraulic force even when the hydraulic drive system is operated under its largest working pressure. That is, the pretension force generated by the spring is always greater than the second hydraulic force generated by the hydraulic oil flowing from the oil supply device to the port C in this disclosure. Below the operation process of the two-position, two-way electromagnetic directional valve is described.

When the electromagnet 50 is energized, the valve element 52 may be elevated upwards till an end point by overcoming the pretension force exerted by the spring 54 and the first hydraulic force applied on the valve element 52 by the hydraulic oil flowing to the first port D. Accordingly, the valve orifice 56 may become opened, and the hydraulic oil may flow from the port C to the port D or from the port D to the port C. In this case, the electromagnetic valve is in a liquid flow status and the valve element is at an open position. When the electromagnet 50 is not energized, the valve orifice 56 is completely closed by the valve element 52 under the pretension force of the spring 54, in which case the flow of the hydraulic oil is shut off in both directions (one direction from the port D to the port C, and an opposite direction from the port C to the port D): on one hand, the valve element is maintained to be at a closed position under the action of the pretension force and the first hydraulic force, and thus the hydraulic oil cannot flow from the port D to the port C; on the other hand, the downward pretension force exerted by the spring 54 on an upper end of the valve element 52 is greater than the second hydraulic force (an upward push force in this case) on the valve element 52 generated by the hydraulic drive system (even under a largest working pressure), and thus the hydraulic oil cannot flow from the port C to the port D in any case. It may be known from the above-described description that the two-position, two-way electromagnetic directional valve may achieve complete and reliable bidirectional shut-off of the flow pass when the two-position, two-way electromagnetic directional valve is not energized, so that the hydraulic cylinder of the operation table may be maintained at any position without any fine movement.

In various embodiments, the hydraulic drive system for the operation table may include an oil supply device, an oil return device, a first two-position, two-way electromagnetic directional valve and a second two-position, two-way electromagnetic directional valve. The oil supply device may drive, through the first and second two-position, two-way electromagnetic directional valves, a hydraulic cylinder so as to drive a piston rod to be extended outwards or retract inwards, thereby controlling and driving various actions of the operation table. The oil supply device may be a unidirectional hydraulic pump that cooperates with a directional valve to control the movement direction of the piston rod of the hydraulic cylinder. The oil supply device may also be a bi-directional hydraulic pump that controls the movement direction of the piston rod of the hydraulic cylinder by controlling its rotation direction. When the first and second two-position, two-way electromagnetic directional valves are energized, the hydraulic oil may be controlled to flow in two directions; instead, when the first and second two-position, two-way electromagnetic directional valves are not energized, the flow of the hydraulic oil is completely shut off in both directions. When the second hydraulic force is abnormal to be much higher than a preset system working pressure, the pressure from the hydraulic oil may only be applied onto one chamber of the hydraulic cylinder and the hydraulic oil within the other chamber cannot be discharged. Therefore, the operation table may still be stable at the stroke end of any action even there is no sensor to limit the stroke end of the action through deenergization and pressure release. The directional valve may be a two-position, four-way directional valve or a three-position, four-way directional valve (where the flow pass is shut off at a neutral position of the valve). The directional valve may be controlled in an electromagnetic way, a mechanically hand-operated or foot-operated way.

In the hydraulic drive system for the operation table of this disclosure, the speed of any action of the operation table may be controlled by controlling an output flow of the hydraulic pump, or by controlling a size of the throttling orifice of a throttling valve or a throttling bolt in any hydraulic circuit.

While this disclosure is described above as detailed illustrations with reference to specific implementations, those of ordinary skill in the art will recognize that various substitutions may be made without departing from the concepts of this disclosure.

The invention claimed is:

1. A hydraulic drive system for an operation table, comprising: oil supply device;

an oil return device; and at least one hydraulic cylinder circuit component, wherein each hydraulic cylinder circuit component comprises a hydraulic cylinder, a first two-position, two-way electromagnetic directional valve and a second two-position, two-way electromagnetic directional valve; wherein the hydraulic cylinder comprises a first chamber without a piston rod and a second chamber with a piston rod disposed therein; wherein a first port of the first two-position, two-way electromagnetic directional valve is connected with the first chamber through a first flow pass, and a first port of the second two-position, two-way electromagnetic directional valve is connected with the second chamber through a second flow pass;

wherein the hydraulic drive system is provided with a first working state and a second working state where the two states are switchable with each other; wherein, in the first working state, the oil supply device is connected to a second port of the first two-position, two-way electromagnetic directional valve and the oil return device is connected to a second port of the second two-position, two-way electromagnetic directional valve, so as to cause the piston rod in the second chamber to extend outwards; and wherein, in the second working state, the oil supply device is connected to the second port of the second two-position, two-way electromagnetic directional valve and the oil return device is connected to the second port of the first two-position, two-way electromagnetic directional valve, so as to cause the piston rod in the second chamber to retract inwards;

wherein the hydraulic oil is controlled to shut off in two directions by the first and second two-position, two-way electromagnetic directional valve when the first and second two-position, two-way electromagnetic directional valve are not energized.

2. The system of claim 1, wherein, in the first working state, hydraulic oil from the oil supply device is shut off to flow from the second port to the first port of the first two-position two-way electromagnetic directional valve when the first two-position two-way electromagnetic directional valve is not energized.

3. The system of claim 1, wherein, in the second working state, hydraulic oil from the oil supply device is shut off to flow from the second port to the first port of the second two-position two-way electromagnetic directional valve when the second two-position two-way electromagnetic directional valve is not energized.

4. The system of claim 1, wherein hydraulic oil from the first chamber is shut off to flow from the first port to the second port of the first two-position two-way electromagnetic directional valve when the first two-position two-way electromagnetic directional valve is not energized; and wherein hydraulic oil from the second chamber is shut off to flow from the first port to the second port of the second two-position two-way electromagnetic directional valve when the second two-position two-way electromagnetic directional valve is not energized.

5. The system of claim 1, wherein the oil supply device is a unidirectional hydraulic pump, and the first working state and the second working state are switched by a third directional valve; and wherein the unidirectional hydraulic pump, the oil return device, the first two-position, two-way electromagnetic directional valve and the second two-position, two-way electromagnetic directional valve are respectively connected with ports of the third directional valve.

6. The system of claim 5, wherein the third directional valve is a four-way directional valve.

7. The system of claim 6, wherein the four-way directional valve is a two-position, four-way electromagnetic directional valve or a three-position, four-way electromagnetic directional valve.

8. The system of claim 5, wherein the first two-position, two-way electromagnetic directional valve, the second two-position, two-way electromagnetic directional valve and the third directional valve are assembled together.

9. The system of claim 1, wherein the oil supply device is a bi-directional hydraulic pump that comprises two outlets; wherein, in the first working state, hydraulic oil is provided to the first two-position, two-way electromagnetic directional valve through one of the two outlets of the bi-directional hydraulic pump; and wherein, in the second working state, the hydraulic oil is provided to the second two-position, two-way electromagnetic directional valve through the other one of the two outlets of the bi-directional hydraulic pump.

10. The system of claim 9, wherein the first two-position, two-way electromagnetic directional valve and the second two-position, two-way electromagnetic directional valve are assembled together.

11. The system of claim 1, wherein a throttling device that is capable for flow regulation is provided in the first and second flow passes.

12. The system of claim 1, wherein an overflow pass is provided between the oil supply device and the oil return device, and the overflow pass is provided with an overflow valve.

13. The system of claim 1, wherein both the first and the second two-position, two-way electromagnetic directional valves further comprise an electromagnet, a valve element and a valve orifice; wherein the valve element is provided with an open position and a closed position; wherein, in the open position, the electromagnet is attached to the valve element so as to cause the valve element to leave the valve orifice whereby the first port and the second port are connected; and wherein, in the closed position, the electromagnet is detached from the valve element so as to cause the valve element to block the valve orifice whereby the first port and the second port are isolated to shut off oil flow in both directions between the first port and the second port.

14. The system of claim 13, wherein both the first and the second two-position, two-way electromagnetic directional valves further comprise a spring; wherein the spring exerts a pretension force onto an upper end of the valve element, and hydraulic oil flowing in the second port exerts a push force onto a lower end of the valve element; and wherein the pretension force and the push force are in two opposite directions, and the pretension force is greater than the push force.

15. The system of claim 13, wherein both the first and the second two-position, two-way electromagnetic directional valves further comprise a spring; wherein the spring exerts a pretension force onto an upper end of the valve element, and hydraulic oil flowing to the second port exerts a push force onto a lower end of the valve element; and wherein an exertion area of the spring on the upper end of the valve element is greater than that of the hydraulic oil on the lower end of the valve element.

16. The system of claim 1, wherein both the first and the second two-position, two-way electromagnetic directional valves further comprise an electromagnet, a valve element and a valve orifice; wherein the side of the valve element facing the valve orifice bulge toward the valve orifice.

17. The system of claim 1, wherein the hydraulic oil is controlled to flow in two directions by the first and second two-position, two-way electromagnetic directional when the first and second two-position, two-way electromagnetic directional valve are energized.

* * * * *